United States Patent [19]

Ghiretti et al.

[11] Patent Number: 4,631,895

[45] Date of Patent: Dec. 30, 1986

[54] CARTONING MACHINE WHICH WRAPS CARTONS ABOUT PREFORMED BLOCKS OF OBJECTS

[75] Inventors: Aldo Ghiretti, Parma; Antonio Pallotti, Bologna, both of Italy

[73] Assignee: O.C.M.E. S.p.A. Officina Costruzioni Meccaniche Emiliana, Parma, Italy

[21] Appl. No.: 724,902

[22] Filed: Apr. 19, 1985

[30] Foreign Application Priority Data

Apr. 27, 1984 [IT] Italy ..... 20710 A/84

[51] Int. Cl.[4] ..... B65B 11/22; B65B 5/06

[52] U.S. Cl. ..... 53/207; 53/209; 53/534

[58] Field of Search ..... 53/48, 209, 534, 537, 53/543, 558

[56] References Cited

U.S. PATENT DOCUMENTS 2,932,929 4/1960 Fahrenbach et al. ..... 53/209
3,513,630 5/1970 Lattke et al. ..... 53/209
4,548,025 10/1985 Heisler ..... 53/209

FOREIGN PATENT DOCUMENTS 2259750 8/1975 France ..... 53/543

*Primary Examiner*—John Sipos
*Assistant Examiner*—Donald R. Studebaker
*Attorney, Agent, or Firm*—Oblon, Fisher, Spivak, McClelland, & Maier

[57] ABSTRACT

In a cartoning machine which wraps cartons about preformed blocks of objects, it is proposed to insert a new carton one after the other into the block feed line before the preceding carton has left the insertion zone, with temporary partial overlap of the cartons, so as to reduce the distance between the successive fed blocks. Furthermore, in the insertion station, the blocks of objects are fed by transverse bars carried in a projecting manner from a chain conveyor disposed entirely on that side of the feed line opposite the side from which the cartons are inserted.

8 Claims, 8 Drawing Figures

CARTONING MACHINE WHICH WRAPS CARTONS ABOUT PREFORMED BLOCKS OF OBJECTS

BACKGROUND OF THE INVENTION

1. Field of the Invention

This invention relates to a cartoning machine which wraps cartons about preformed blocks of objects, such as bottles, cans or other similar containers.

2. Discussion of Related Art

Automatic cartoning machines are known in which the objects to be cartoned arrive from an accumulation conveyor line, and are divided into blocks each formed from a required number of rows and columns of objects, to then proceed as suitably spaced-apart blocks with a continuous movement on a feed line aligned with the accumulation conveyor line, along said feed line there being disposed in succession various operating stations in which the different operations are carried out, namely: inserting a carton under each block, using flat prepunched cartons withdrawn from a store; folding the flaps of the carton so as to wrap it about the block; and folding and glueing the side portions of the carton to finally obtain a closed carton which completely encloses the block of objects and is ready for despatch.

The spaced-apart blocks of objects are fed through the successive operating stations generally initially by means of a chain conveyor with transverse thrust bars disposed at a predetermined pitch, and later by a prong conveyor, with the prongs acting on the tail end of the blocks after they have been partly wrapped by the relative cartons.

In these cartoning machines, certain difficulties are encountered in the station in which the individual cartons are inserted under the individual blocks of objects. This station normally lies at the end of the chain conveyor having the transverse thrust bars. The flat punched carton, withdrawn from the carton store, is urged by suitable thrust members transversely to the block feed line, and before its horizontal part is inserted under the relative block, another part of the carton is folded upwards through 90° so that when the carton is inserted under the block of objects, this vertical folded part of the carton closes the front end of the block (with reference to its feed direction). Under these conditions, the horizontal part of the carton obviously projects rearwards from the block of objects, in the form of the flap which, after being folded, is to close the rear end of the block, and the vertical part of the carton projects upwards from the block, in the form of the flap which after folding is to close the top of the block. The carton which has just been inserted under the block projects from its two sides in the form of side portions which, after folding, laterally close the block of objects.

Now during the insertion of the horizontal part under the block, the vertical part of the carton creates interference difficulties with the block thrust bars, and more precisely with the side chains which support said bars, so that the carton has to be inserted transversely to the feed line at the end of the chain conveyor where this conveyor is deviated upwards, so as to obviate said interference. Furthermore, the horizontal part of the carton, and in particular the rear projection which projects beyond the base of the relative block, requires a considerable increase in the pitch of the chain conveyor thrust bars if interference between the successive cartons inserted under the fed blocks of objects is to be prevented. It is apparent that this circumstance considerably limits the productivity of these known cartoning machines.

SUMMARY OF THE INVENTION

The object of the present invention is therefore to provide a cartoning machine of the aforesaid type which allows substantial productivity increase by means of a special arrangement which is simple to effect and without having to modify the operating members provided for the various subsequent operations, with a subsequent saving in the number of machines installed in the packing and dispatch department, and a relative reduction in supervising labour. This object is attained according to the invention by reducing the distance between the fed packs of objects by temporarily and partially superposing the cartons during their insertion, i.e., by commencing the insertion of the next carton above the rear flap of the horizontal part of the preceding carton, utilising for this operation the free space between the bar which urges the preceding block and the front of the next block.

This concept is attained by a cartoning machine according to the present invention, which is characterised in that in the position corresponding with the carton insertion station, the blocks of objects are urged along the feed line by transverse bars supported in a projecting manner by conveying chains disposed on only one side of this line, in the insertion station there being provided a raisable and lowerable slide table for the blocks of objects, and, laterally to said slide table on the opposite side to said conveying chains, a lateral guide positioned at a lower level than that of the slide table, upstream of this lateral guide, with reference to the block feed direction, there being provided a lateral presser member which can be operated in order to lower the corresponding rear side portion of the horizontal part of the cartons in order to introduce it under said lateral guide, the insertion plane in a direction transverse to the feed line of the horizontal parts of the cartons being at a level which is higher than said lateral guide and lower than the slide table for the blocks when in its raised state. The movements of the presser member and of the operating mechanism for raising and lowering the slide table are suitably synchronised with each other and with the feed movements of the thrust bars for the blocks of objects and of the carton pusher members, in such a manner that the rear side portion of the horizontal part of the inserted cartons becomes lowered at the correct time for introduction below the lateral guide, that the slide table becomes raised slightly before a new carton is pushed on to the feed line of the blocks of objects, and that the carton insertion operation commences as soon as the thrust bar of the preceding block has passed beyond said raisable and lowerable slide table.

BRIEF DESCRIPTION OF THE DRAWINGS

The characteristics of the invention and the advantages deriving therefrom will be more apparent from the description of one embodiment thereof given hereinafter by way of example with reference to the accompanying drawings, in which.

DETAILED DESCRIPTION OF THE PREFERRED EMBODIMENTS

Figure 1:
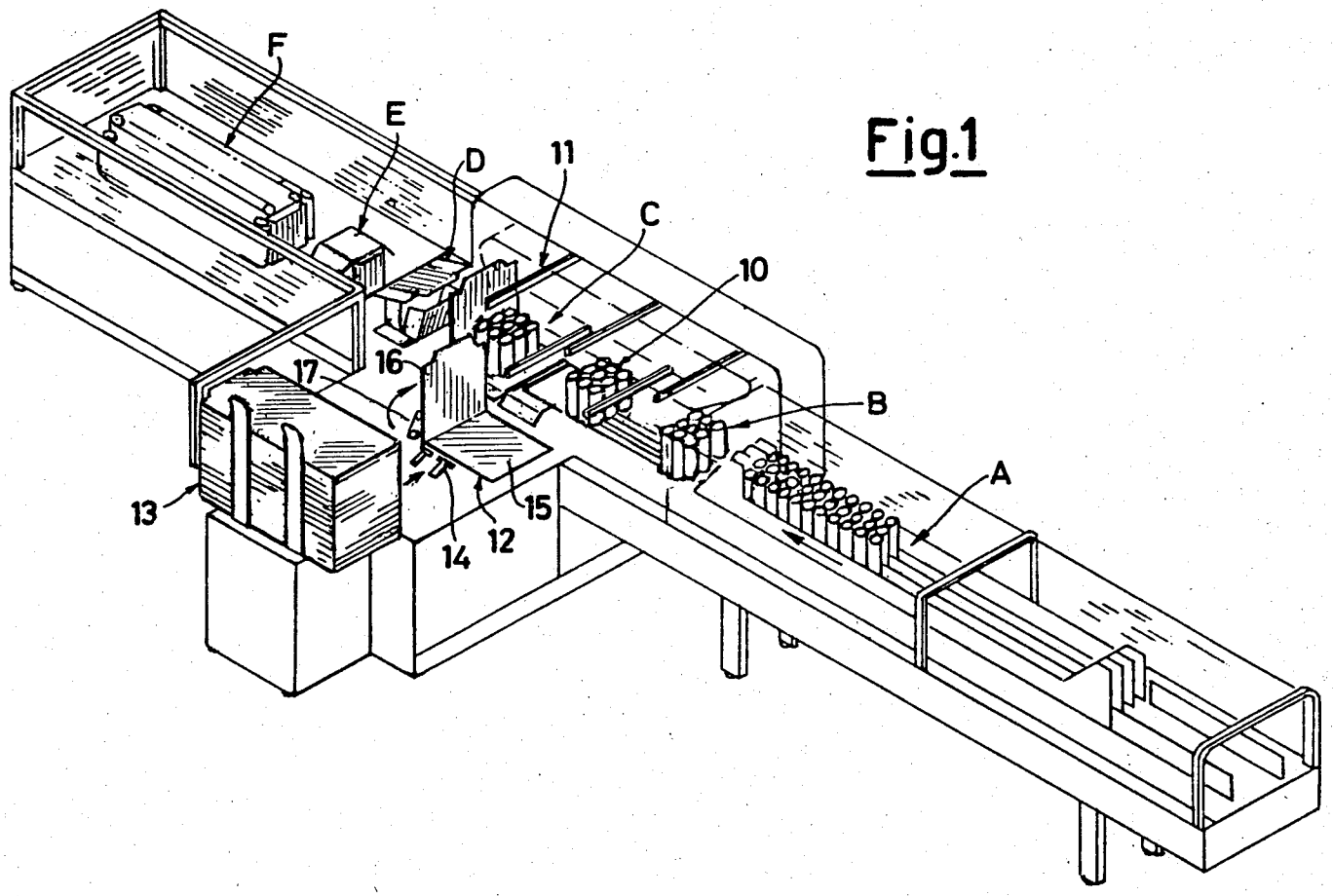
FIG. 1 is a diagrammatic perspective view of the entire cartoning machine.

With reference firstly to FIG. 1 of the drawings, this diagrammatically illustrates the entire cartoning machine with its various operating stations, namely an accumulation conveying line A on which the objects advance in parallel touching rows, a station B for division into individual spaced-apart blocks, each formed from a determined number of columns (in the case considered there are three parallel rows and three columns of objects in each block), a station C in which the prepunched cartons are inserted, and stations D, E, F for folding and glueing the cartons, in order to enclose them about each block of objects.

The present invention relates specifically to the carton insertion station C, the other stations of the machine being of known type and are therefore not described in detail.

In station C, the individual blocks 10 of objects are fed along a feed line aligned with the accumulation conveying line A by means of a chain conveyor with suitably spaced-apart thrust bars, and indicated overall by 11.

The individual cartons 12 are withdrawn from a flat carton store 13 in known manner, not shown, and, by means of pusher members 14, are pushed transversely to the feed direction of the blocks 10 so that their horizontal part 15 becomes inserted below each block, whereas another part 16 which has been previously folded upwards through 90° by a suitable folder member 17 becomes disposed vertically in front of the relative block.

This general method of operation, and the members which effect it, are of known type, so that only those parts and their operation which distinguish the machine according to the invention from the known art are described in detail hereinafter.

Figure 3:
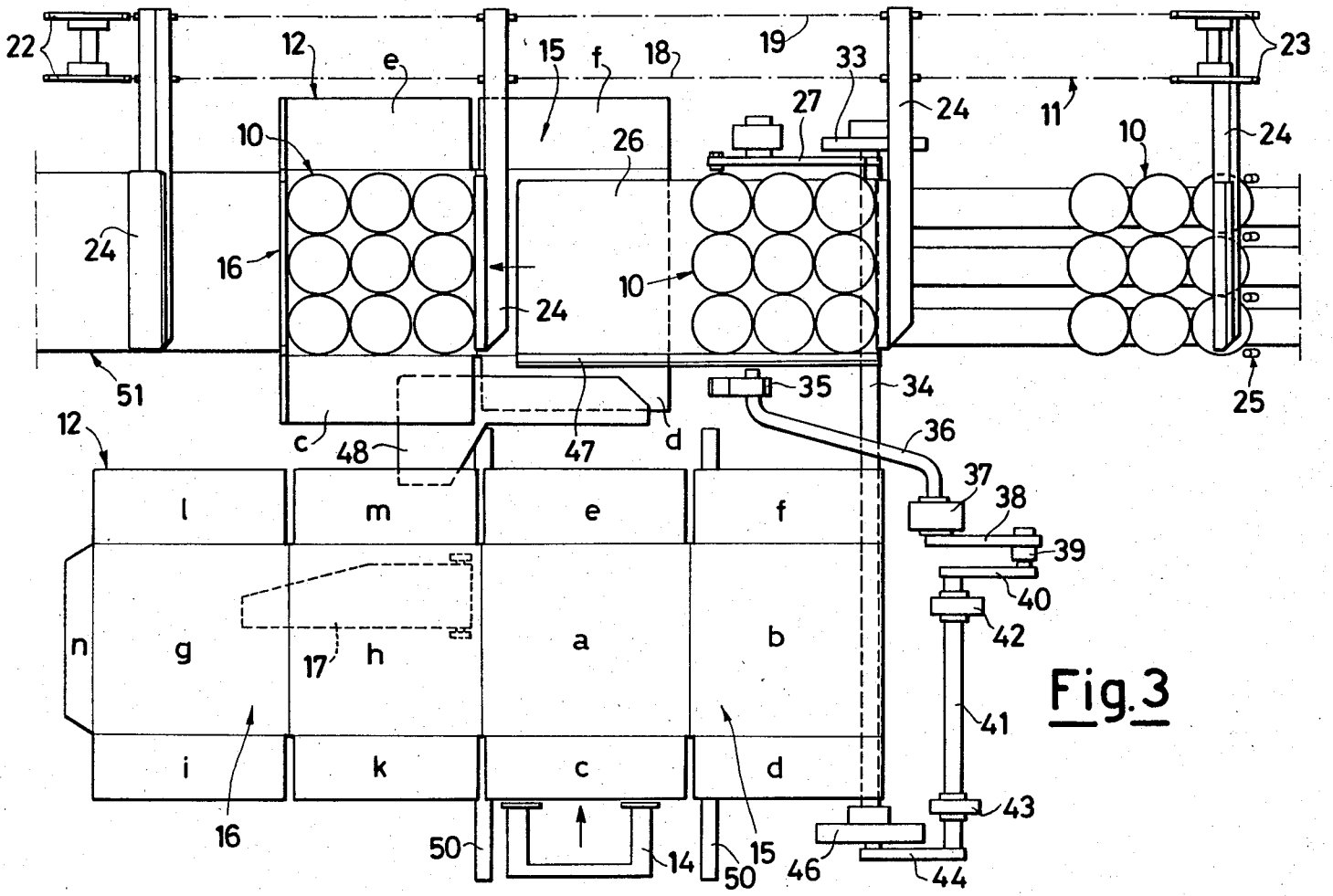

FIG. 3 shows a flat carton 12 which is to be wrapped about a block 10. The carton 12 has been prepunched and comprises prescored creasing lines which define the following zones: in the part 15 a base a, a rear flap b, two portions c and d on one side and two portions e and f on the opposite side, and in the part 16 an upper flap g, a front flap h, two portions i and k on one side, two portions l and m on the opposite side and a closure tab n (these definitions relate to the position of the various zones when the carton 12 completely wraps a block 10 of objects).

The thrust-bar conveyor 11 in the carton insertion station C is of the type comprising two chains 18 and 19 which are disposed spaced-apart in parallel vertical planes both on one and the same side of the feed line for the blocks 10. In FIGS. 2 to 7, the feed direction is from right to left, and the two chains 18, 19 are located to the right of the feed line. Suitable pairs of deviation rollers 20, 21, 22 and 23 guide the chains through an endless circuit comprising a lower horizontal active portion and an upper horizontal return portion.

At regular distances apart, the chains 18 and 19 carry projecting thrust bars 24, said bars being disposed transversely to the feed line and penetrating into the path of the blocks 10 of objects, so that each bar 24 urges one block 10 forwards, on withdrawing the blocks from an upstream prong conveyor 25.

In the carton insertion station C, the left hand side of the block feed line is therefore free and unobstructed, so that the insertion can be carried out freely from the left hand side by means of pusher members 14 (see FIG. 3).

In the station C there is provided a slide table 26 for the blocks 10, said slide table being in a position slightly inclined upwards in the feed direction and lowerable into a substantially horizontal position. For this purpose, the table 26 is supported at its rear by a right-angled lever 27 (FIG. 2) pivoted at 28, said lever 27 being connected by a tie rod 29 to a double-arm lever 30 pivoted at 31, and having its end engaged in an eccentric groove 32 of a cam 33 fixed to a shaft 34. It is apparent that when the shaft 34 carrying the cam 33 is rotated, the right-angled lever 27 undergoes rocking motion, so that the slide table 26 rocks about the pivot 28. To the side of the slide table 26 (to the left with respect to the feed direction) there is provided a presser member 35 carried by a curved arm 36 mounted rotatably in a support 37 and rigid with another arm 38. This latter arm 38 is connected by a rod 39 to a lever 40 rigid with a shaft 41 rotatable in supports 42, 43. The other end of the shaft 41 is rigid with a lever 44, the free end of which engages in an eccentric groove 45 of a cam 46 also fixed to the shaft 34. Rotation of the shaft 34 and cam 46 to therefore causes the presser member 35 to undergo raising and lowering movements synchronously with the raising and lowering movements of the slide table 26.

It should be noted that the slide table 26 has on the carton introduction side an edge 47 which is bent slightly upwards and whose purpose is described hereinafter (see FIG. 8). Again to the side of the slide table 26, on the left with respect to the block feed direction and downstream of the presser member 35, there is provided a downwardly inclined lateral guide 48 (see FIG. 8), the upper edge of said guide being at a slightly lower level than the slide table 26. The lateral guide 48 is fixed to and carried by a support shown diagrammatically in FIG. 8 and indicated by 49. The fixed lateral guide 48 extends in the feed direction beyond the raisable and lowerable slide table 26, and its purpose is described hereinafter. The cartons 12 withdrawn from the pile 13 and fed transversely to the feed line of the blocks 10 by pusher members 14 slide on guide bars 50 which terminate in the vicinity of the lateral guide 48 and of the presser member 35 respectively. Finally, the reference numeral 51 indicates a chain conveyor which is aligned with the slide table 26 and on to which the blocks 10 semi-wrapped by relative cartons 12 are pushed by the bars 24 of the conveyor 11, said conveyor 51 transferring the blocks to the subsequent operating stations D, E and F.

The operation of the carton insertion station C of the cartoning machine according to the invention is as follows.

The blocks 10 of objects fed by the prong conveyor 25, and already spaced-apart on arrival, are engaged by the projecting bars 24 of the conveyor 11 in order to be further urged forwards. The projecting bars 24 urge the blocks 10 firstly on to the slide table 26 and then on to the conveyor 51.

Figure 2:
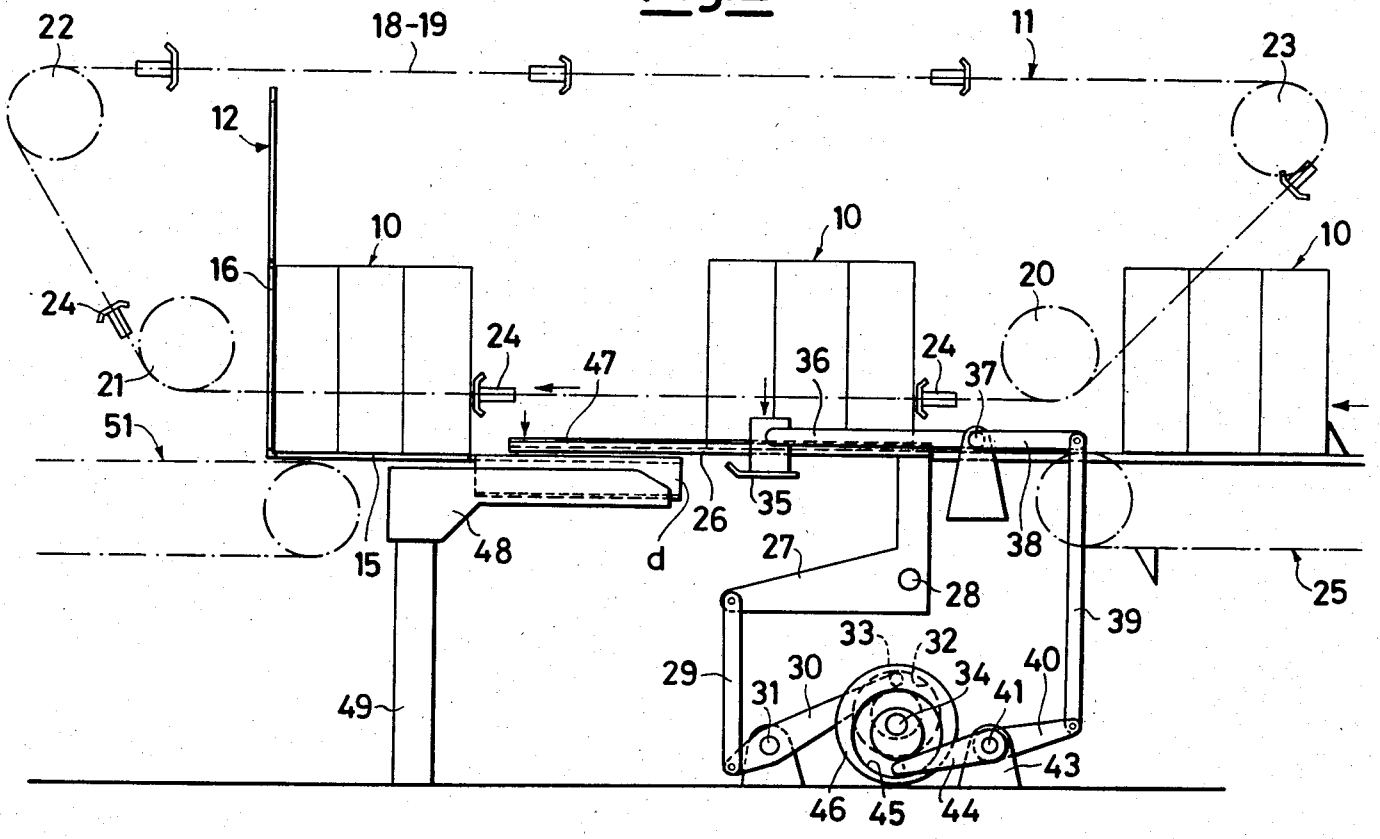
FIGS. 2 and 3 are a diagrammatic side and plan view respectively of the carton insertion station in a first operating stage.

FIGS. 2 and 3 show the situation in which a block 10 is still on the conveyor 25, another block has just arrived on the slide table 26, and a third more forward block, already semi-wrapped by a carton, is to be transferred on to the conveyor 51. In this situation, the slide table 26 is lowered and is in a practically horizontal position, and the presser member 35 is also lowered. It should be noted that the carton semi-wrapped about the block which is to be transferred on to the conveyor 51 has the flap b of its horizontal part 15 inserted under the slide table 26 and the rear side portion d folded under the lateral guide 48, as clearly shown in FIGS. 2 and 3. In FIG. 3 a new carton 12 can also be seen, still lying flat, this being urged along the guide bar 50 by the pusher members 14, and being designed to wrap the next block, i.e., that which in this situation has just arrived on the slide table 26. The new carton 12 is about to be folded by the folder member 17 in order to turn its part 16 into a vertical position, as shown in FIG. 5.

Figure 4:
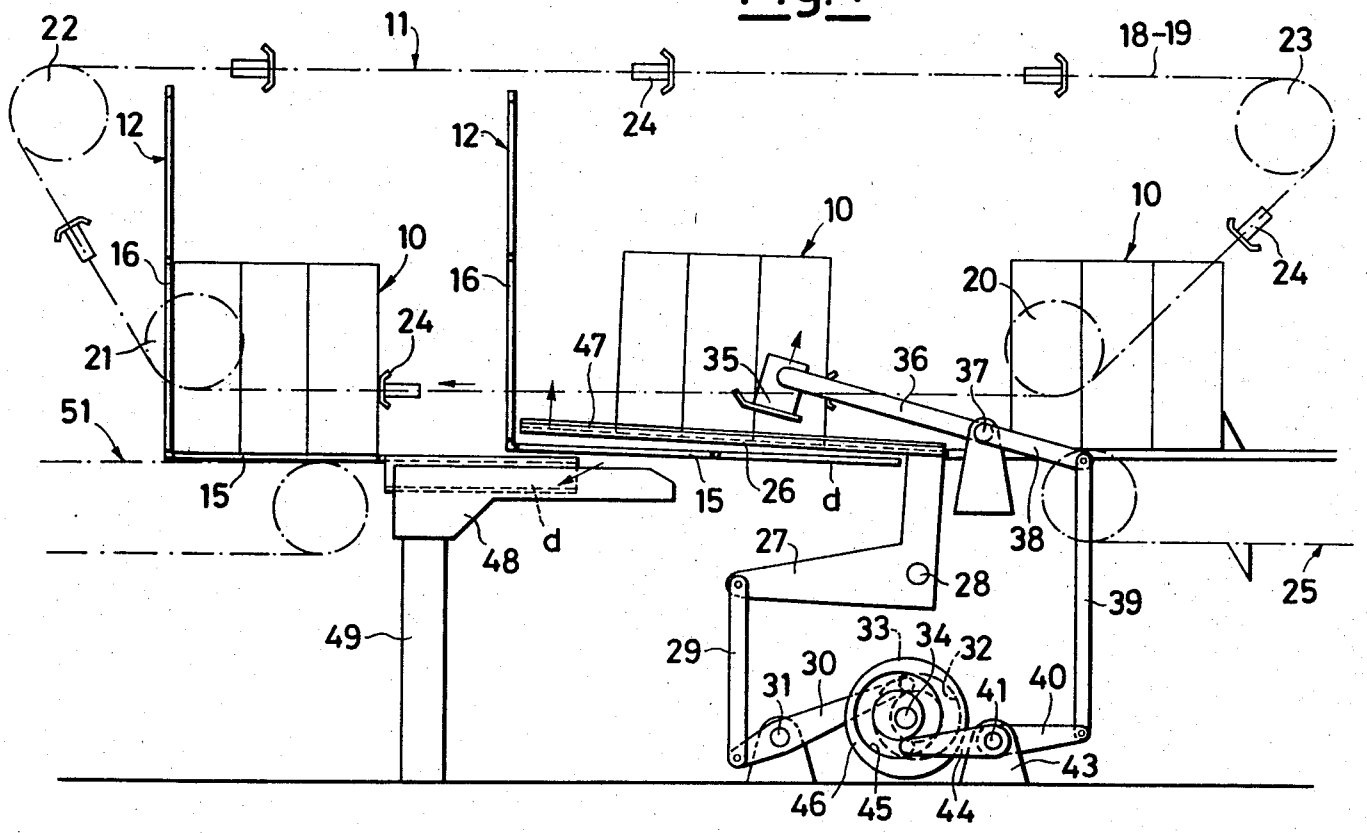
FIGS. 4 and 5 and FIGS. 6 and 7 are analogous views to FIGS. 2 and 3 showing the said insertion station in two different operating stages.
Figure 5:
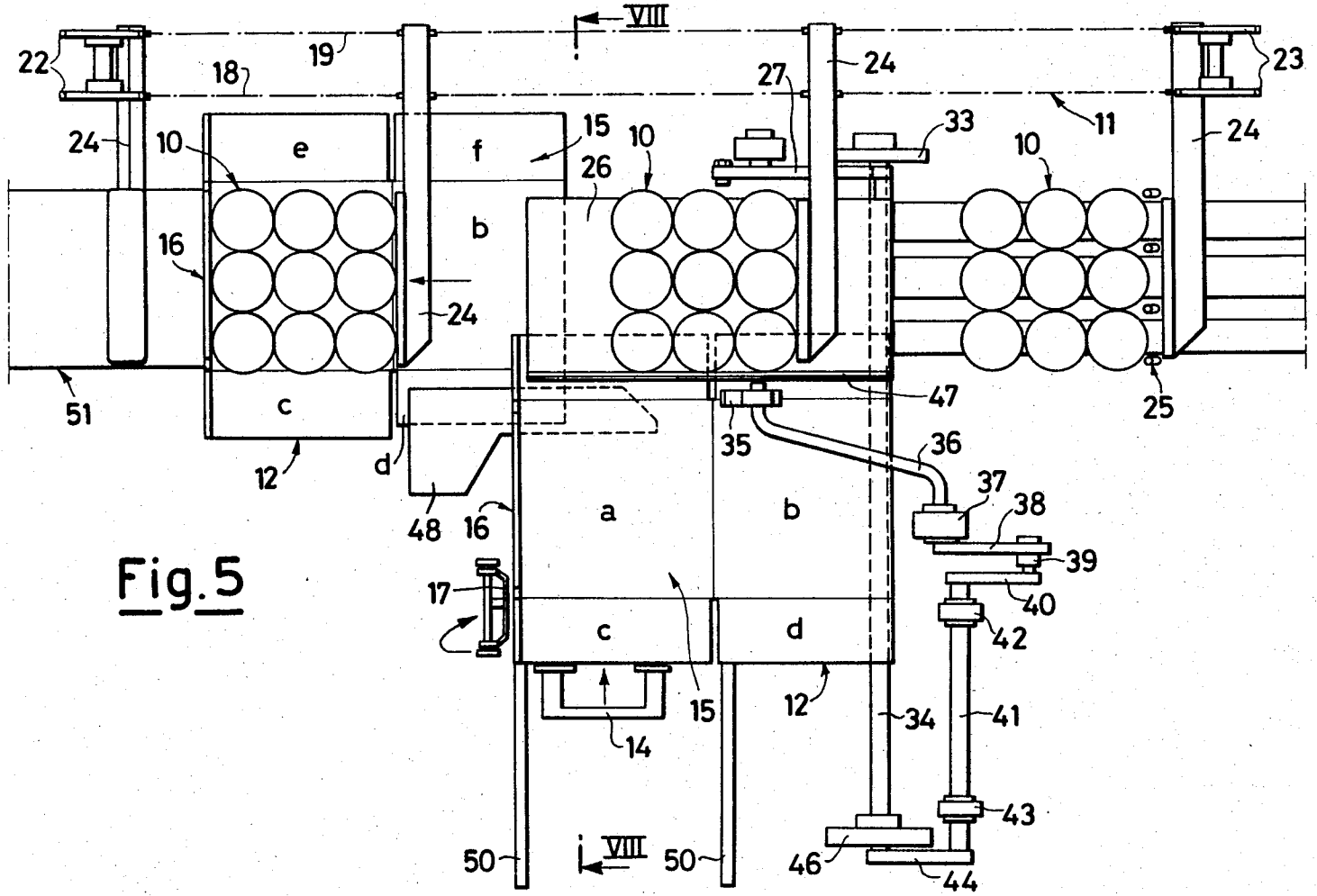
Figure 8:
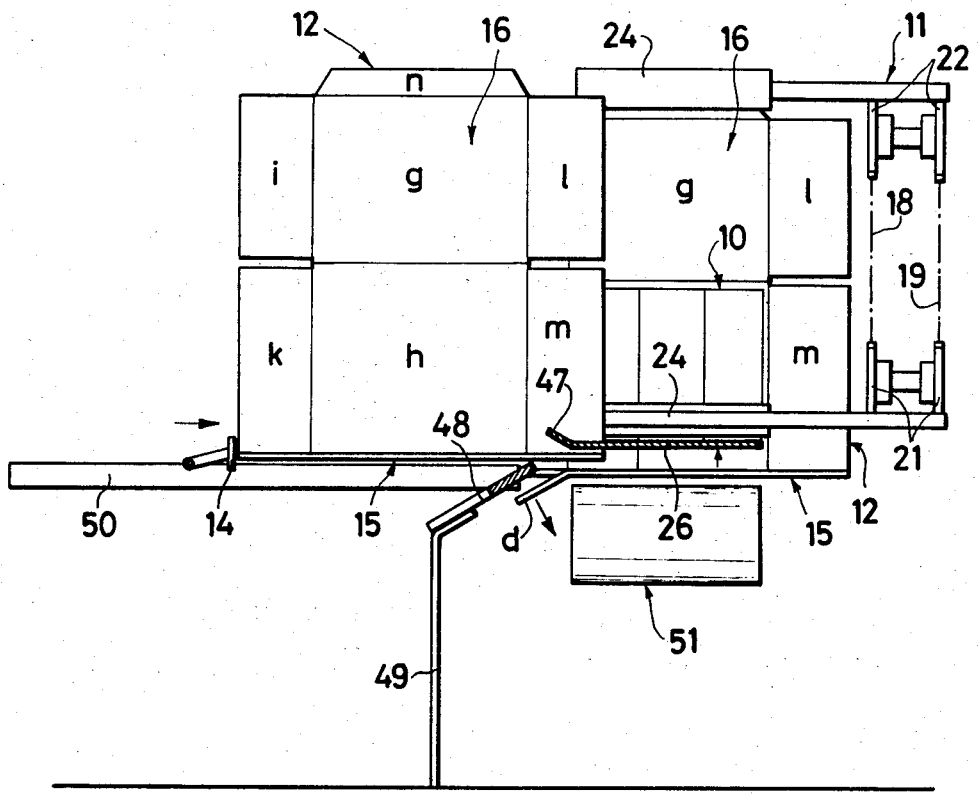
FIG. 8 is a diagrammatic section on the line VIII—VIII of FIG. 5.

FIGS. 4, 5 and 8 shown a situation subsequent to that illustrated in FIGS. 2 and 3, i.e., the initial stage of insertion of the new carton, which in FIG. 3 was still in a flat extended state. In this situation, all three blocks have been advanced through a certain distance by the projecting thrust bars 24. The slide table 26 and presser member 35 are both raised. The new carton 12, urged by the pusher members 14 and with its part 16 already in a vertical position, is introduced by way of its horizontal part 15 under the raised slide table 26 as soon as the projecting thrust bar 24, acting on the first block on the left in the figures, has passed beyond the insertion trajectory of said vertical part 16 of the new carton, said horizontal part 15 of the new carton being guided on the lateral guide 48 which keeps the rear side portion d of the preceding carton lowered. This insertion is also facilitated by the inclined edge 47 of the slide table 26, said edge constituting a lead-in for correct insertion, as clearly shown in FIG. 8. The new block 10 of objects which is to be wrapped by this new carton currently undergoing insertion, is located on the raised slide table 26. It is apparent that this arrangement prevents any interference between the new carton about to be inserted, the conveyor 11 with the projecting bars 24, the blocks of objects and the previous carton, even though there is partial temporary overlap between the horizontal parts of the preceding and of the new carton. By virtue of this overlap, i.e., the fact that the new carton can be inserted into the feed line of the blocks of objects before the horizontal part of the preceding carton has completely left the insertion area, it is possible to reduce the distance between the fed blocks of objects and thus increase the machine productivity, for equal block advancement speeds.

In practice it has been found that using the special arrangements according to the invention, the reduction in the distance between the projecting thrust bars 24 can be 50%–80% compared with known systems, which for equal linear speeds corresponds to a machine productivity increase of 50%–80%. Moreover, by virtue of the fact that the cartons with their vertically folded part can be inserted into the feed line while still within the ambit of the projecting thrust bar conveyor, ie between successive thrust bars, all the pitch distances of the machine become equal, starting from the station B and terminating at the exit, so that all the blocks advance at constant speed and can easily withstand the productivity increase obtained by introducing the cartons in temporary partial mutual overlap.

Figure 6:
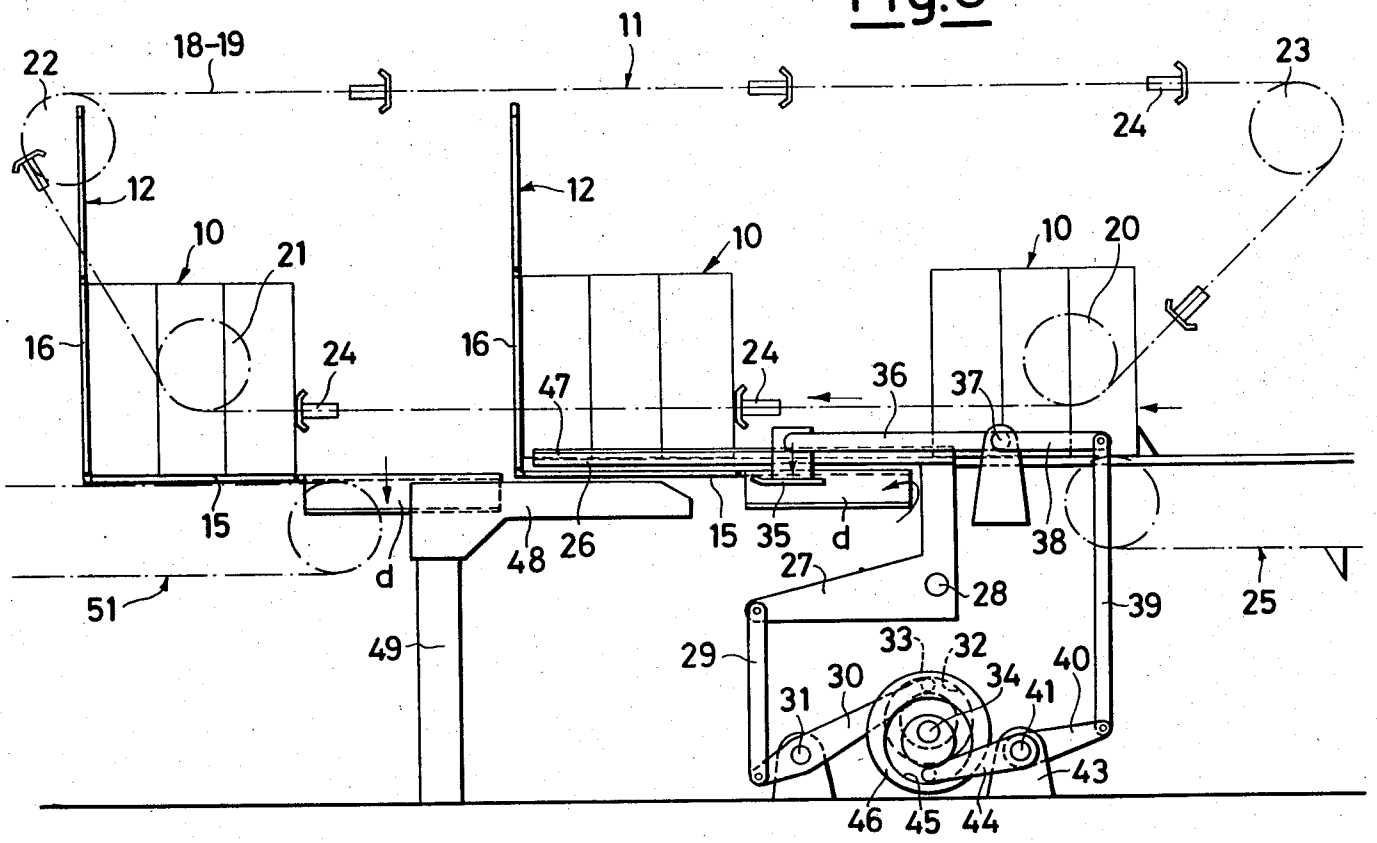
Figure 7:
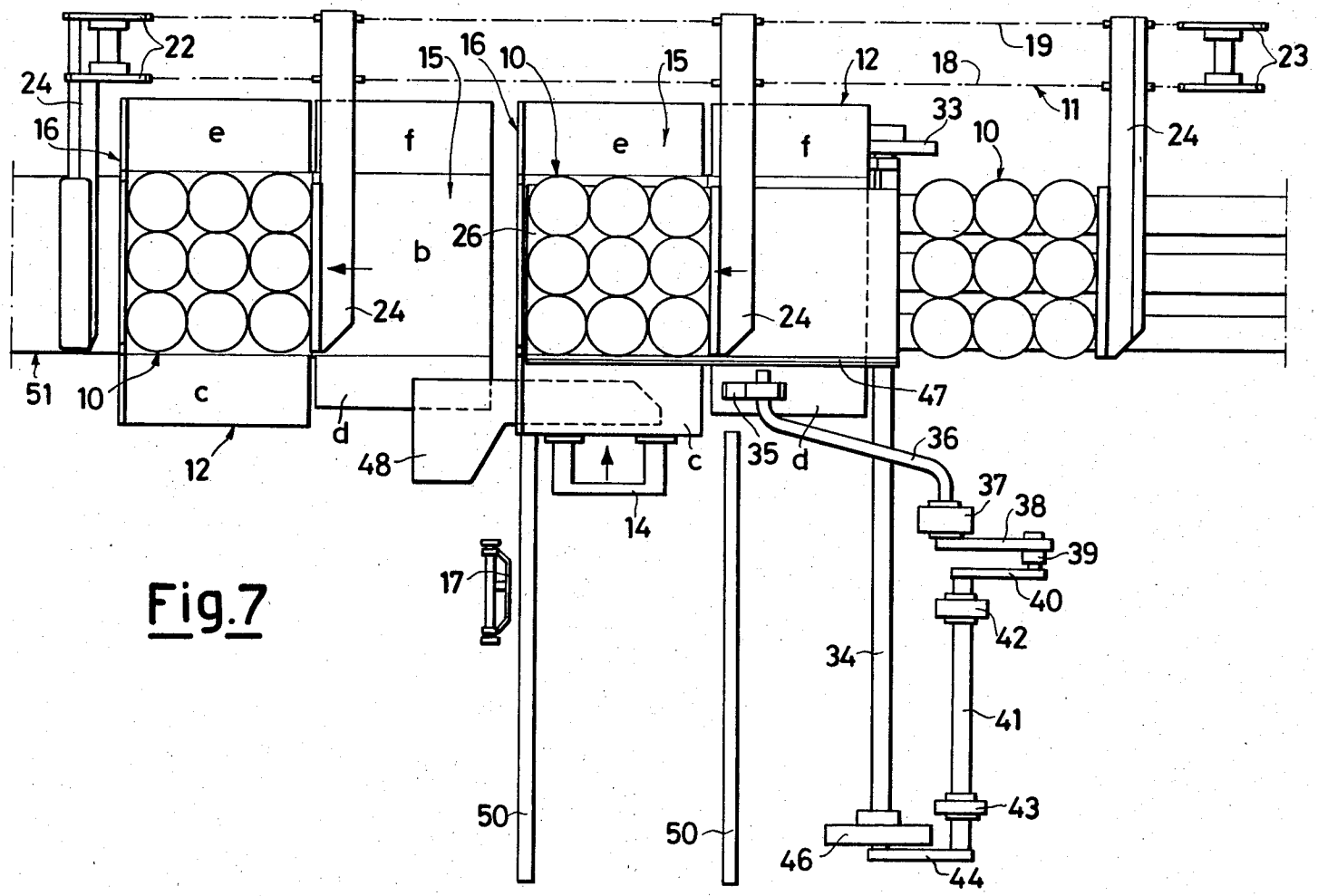

Returning to the description of operation, FIGS. 6 and 7 show a further stage subsequent to that illustrated in FIGS. 4, 5 and 8. In this stage, the slide table 26 is again lowered, the new carton is completely inserted and the relative new block of objects abuts with its front end against the vertical part 16 of this new carton. In this situation, the rear side portion d of the new carton passes below the presser member 35 and this, on lowering, lowers the side portion d so as to arrange it for passing below the lateral guide 48.

FIG. 7 shows how, after the complete insertion of the new carton into the feed line, there remains a space between this new carton and the previously inserted one, this space being small, indicated by "x", and being that which is absolutely necessary for implementing the subsequent folding and closing stages of the cartons. After the return of the pusher members 14 and the retracting of the folder members 17, the situation is that shown in FIGS. 2 and 3, and a new carton insertion cycle can commence.

The drawings do not show the means for driving the various conveyors and mobile members. It is apparent that these drive means and the means for mutually synchronising the various movements for obtaining the described operational stages can be easily conceived by an expert, and no detailed illustration and description thereof are required.

We claim:

1. A cartoning machine for wrapping carton about preformed blocks of objects, comprising:

means for sequentially feeding blocks of objects in a feeding direction along a feed line;

carton folding means for initially folding a carton such that the carton has a horizontal portion and a vertical portion attached to a downstream end of said horizontal portion in said feeding direction;

a substantially horizontal slide table at an insertion station of said feed line;

means for selectively raising and lowering said slide table;

a lateral guide positioned at one lateral side of said feed line and positioned lower than said slide table in a raised position thereof;

means for laterally feeding said initially folded cartons to said insertion station from said one side thereof, such that said horizontal portion is fed between said slide table having one of said preformed blocks thereon and said lateral guide, and such that an upstream portion of said horizontal portion is positioned upstream of said lateral guide in said feeding direction; and presser means for pushing said upstream portion of said horizontal portion below said lateral guide when said initially folded carton is in said insertion station, whereby said horizontal portions of succeeding ones of initially folded cartons can partially overlap one another at said insertion station when said pushed upstream portion of said horizontal portion is positioned beneath said lateral guide.

2. The machine of claim 1 wherein said means for sequentially feeding includes:

driven chain means extending parallel to said feed line only in a side thereof opposite said one side; and thrust bars fixed to said chain means and traversing said feed line.

3. A machine as claimed in claim 2 including means for coordinating movement of said slide table and said presser means.

4. A machine as claimed in claim 2 including means downstream from said insertion station in said feeding direction for fully folding each said carton about one said block and for sealing said carton.

5. The machine as claimed in claim 2 wherein said lateral guide is inclined and has an upper edge parallel to the feed line.

6. The machine as claimed in claim 2 wherein an edge of the slide table at said one side of said feed line is inclined upwards.

7. The machine as claimed in claim 2 wherein said means for raising and lowering comprising means for rocking said slide table about an axis transverse to said feed line and situated upstream with respect to the feed direction.

8. The machine as claimed in claim 7 including means for inducing said rocking motion of the slide table.

* * * * *